United States Patent [19]

Bigelow et al.

[11] 4,437,646

[45] Mar. 20, 1984

[54] DISCHARGE VALVE FOR CONCRETE PUMPING APPARATUS

[75] Inventors: David E. Bigelow, Milwaukee; Terry Timmerman, Grafton, both of Wis.

[73] Assignee: Construction Forms, Inc., Cedarburg, Wis.

[21] Appl. No.: 317,245

[22] Filed: Nov. 2, 1981

[51] Int. Cl.[3] ..... F16K 51/06; G05G 1/04

[52] U.S. Cl. ..... 251/145; 251/228; 251/279; 74/96; 74/520

[58] Field of Search ..... 74/96, 97, 106, 520, 74/424.8 VA; 251/145, 228, 279

[56] References Cited

U.S. PATENT DOCUMENTS

| | | | |
|---|---|---|---|
| 1,381,511 | 6/1921 | Smith | 251/279 |
| 2,373,001 | 4/1945 | Allen | 74/424.8 VA |
| 2,995,043 | 8/1961 | Lusk et al. | 74/97 |
| 3,074,432 | 1/1963 | Beale et al. | 251/145 |
| 3,556,116 | 1/1971 | Allen | 251/145 |
| 4,158,367 | 6/1979 | Maillet | 74/96 |

*Primary Examiner*—A. Michael Chambers

*Attorney, Agent, or Firm*—Andrus, Sceales, Starke & Sawall

[57] ABSTRACT

A "dump" valve for a concrete pumping line includes a tubular valve body for in-line connection in a distribution line and an end hinged cover plate for opening the valve. The valve includes a short rectangular discharge pipe, including flat walls, secured in a rectangular side wall opening in the valve body. The pipe has an outer flat end. A valve cover plate somewhat larger than the rectangular discharge pipe is provided with a sealing, gasketed face. The cover plate is hinged at one axial end to the valve body and is pivotally mounted to move between a closed position engaging the flat end of the discharge pipe and a pivoted depending open position in which the plate is swung clear of the bottom end of the discharge pipe section. An operating handle having an over-the-center latch linkage is coupled to the cover.

12 Claims, 6 Drawing Figures

DISCHARGE VALVE FOR CONCRETE PUMPING APPARATUS

BACKGROUND OF THE PRESENT INVENTION

This invention relates to a concrete distribution system for high pressure pumping of concrete, cement and the like in construction of roads, buildings and the like, and in particular to such a concrete pumping and distribution system having a distribution line including one or more valve units connected serially in the line with a side discharge for discharging of the concrete material intermediate the total length of the pumping line.

Concrete pumping systems are now extensively used in the laying and distribution of concrete and cement in the construction of buildings, roads and the like. In such systems, a high pressure concrete pump receives the concrete mixture and forces it into and through a line or lines from the pumping station to the depositing station. The distribution lines are generally formed from steel or flexible tubing sections interconnected to each other with quick detachable or releasable couplings. To avoid the necessity of moving the discharge end of the pipe line and/or to permit the selective distribution at multiple points along the distribution line, the high pressure pumping line may be provided with a "dump" valve means at appropriate intermediate locations in the line. For example, U.S. Pat. No. 2,021,108 which issued Nov. 12, 1935 and U.S. Pat. No. 2,092,961 which issued Sept. 14, 1937, disclose similar side-discharge gate valves adapted to be interconnected within a concrete distribution line for purposes of discharge at an intermediate point along the pumping line. The gate valve heretofore has generally been constructed with a valve cover essentially corresponding to the tubular configuration of the pumping line. In the closed position of the gate valve, the valve presents a smooth continuation of the flow path within the pump line. Thus, the workers in the art of concrete pumping have generally considered a smooth, continuous path of substantial importance to avoid buildup of concrete within a pocket in the line. Pumping of the concrete and the like normally uses pumps operating at pressures of 500 PSI and above. In addition, surge pressures of greater magnitude are encountered in the system. Although intermediate dump valves provide convenient deposit of the mixture, it has been found difficult to create a highly effective seal of the valve in the presence of high pumping pressures.

the present invention is particularly directed to an improved valve for concrete pumping apparatus and the like having an improved seal structure particularly based on the realization that in many instances an offset chamber or pocket of a relatively small size is acceptable.

SUMMARY OF THE PRESENT INVENTION

The present invention is thus particularly directed to a high pressure, valve apparatus connected as an in-line valve structure within a high pressure pumping line such as a concrete pumping system operating with a pressurized source of 500 PSI and above. Generally, in the present invention, the high pressure valve structure includes a valve body adapted to be connected as a series portion of the line and provided with a special discharge side opening including an outwardly projecting pipe section terminating in a flat sealing end. A closure means or cover having a complementing flat sealing face is mounted for selected abutting engagement with the flat sealing end of the pipe section, with a connection means creating a high pressure seal over the entire sealing face of the pipe section. The inventors have found that the flat sealing surface provides a more effective seal under practical concrete pumping pressure specifications, and by proper construction of the pipe section, the pocket does not interfere with operation of the distribution system.

More particularly, in accordance with a preferred embodiment of the present invention, a rectangular opening is formed in the side of a tubular valve body section. The length of the opening is preferably substantially larger than the diameter of the concrete pumping line while the depth of the opening is made approximately $\frac{1}{3}$ the depth of the pumping line. A rectangular discharge pipe, including flat walls, are secured in the rectangular opening to form a lateral extension, and in a practical construction a vertical drop opening to the underside of the a valve body. A valve cover plate somewhat larger than the rectangular discharge pipe is provided with a sealing gasketed face. The cover plate is hinged at one axial end to the valve body and is pivotally mounted to move between the closed position engaging the flat end of the discharge pipe and a pivoted depending opon position in which the plate is swung clear of the bottom end of the discharge pipe section. An operating handle is coupled through a latch linkage to the cover and is preferably formed as a pivoted over-the-center latch linkage mounted to the opposite side of the valve body from the discharge plate and connected thereto by an over-center link.

In a particularly satisfactory commercial embodiment, a pivot support means is connected to the valve body opposite the discharge pipe. A handle assembly is pivoted to the pivot support and extends upwardly therefrom. A connecting link is connected to the outer end of the handle assembly and to the cover such that as the handle moves to one side of the pivot support it moves the cover plate into latched, sealing engagement with the discharge pipe section. A stop means limits the movement of the handle to prevent collapse of the linkage with the cover plate in the closed position. Pivoting of the handle assembly in the opposite direction, simultaneously releases the cover plate and drops the cover plate to the depending open position. The linkage includes an adjustment to permit varying of the length of the linkage to accommodate and compensate for tolerances in the construction of the discharge pipe and the linkage.

In a preferred embodiment the linkage means includes a dual linkage to the opposite sides of the valve body. An H-shaped handle includes a pair of side levers or links with a stop plate connected to the centers thereof and with the handle connected to the center section. The side links are pivoted at the lower end to hinge pivot members secured to the valve body. The top end of the handle lever or links are provided with slot and pinned connections to the corresponding ends of a pair of connecting links. The slot and pin connections include an adjustable setting means for varying of the relative positions of the pin and slot to vary the positioning of the connecting link with respect to the valve body and the discharge pipe section. The valve links extend from the pin connections past the valve body with the opposite outer ends pivotally interconnected to the sides of the flat cover plate. A cover plate hinge means is secured to the one end of the plate and to the adjacent valve body. The cover plate hinge means includes a pin and elongated slot connection which permits the pivoting of the cover plate from the sealing closed position to the open position.

The present invention particularly in the preferred embodiment has been found to provide a more effective and reliable high pressure "dump" valve for high pressure concrete pumping systems and the like.

BRIEF DESCRIPTION OF THE DRAWINGS

The drawings furnished herewith illustrate a preferred construction of the present invention in which the above advantages and features are clearly disclosed as well as others which will readily be understood from the following description.

In the drawings.

DESCRIPTION OF THE ILLUSTRATED EMBODIMENT

Figure 1:
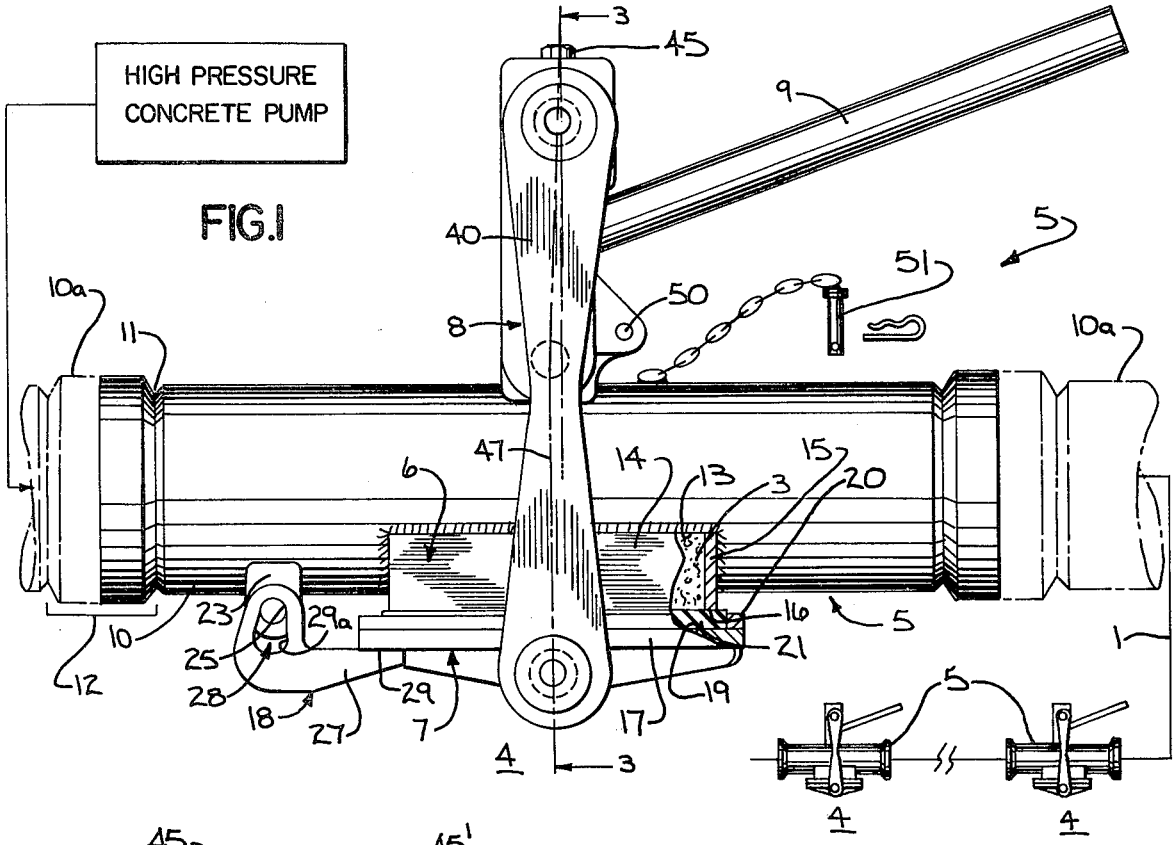
FIG. 1 is a side elevational view of a concrete pumping system with a diagrammatic illustration of a pump connected to a flow line incorporating a side discharge valve constructed in accordance with a preferred embodiment of the present invention.
Figure 2:
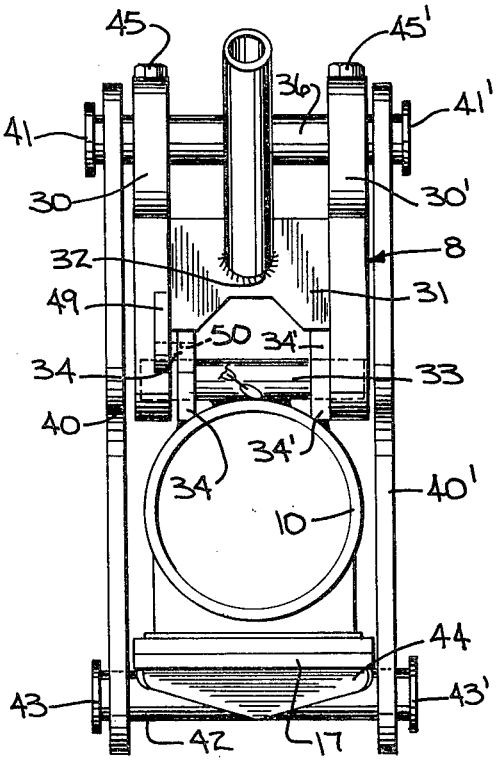
FIG. 2 is an end view of the valve structure shown in FIG. 1.

Referring to the drawings and particularly to FIG. 1, a concrete distribution system includes a distribution line 1 connected to a high pressure concrete pump 2 as a source of a concrete mixture 3. The line 1 transports the concrete mixture 3 from the source 2 to one or more deposit site 4. The concrete pump 2 thus operates to continuously supply concrete to the flow line 1 preferably under a constant pressure condition and at a pressure generally in excess of 500 PSI. In the illustrated embodiment, a series of deposit sites is diagramatically shown located along the length of the flow line as at 4. A side discharge valve unit 5, one of which is shown in detail, is connected in the flow line 1 at each deposit side 4 for dropping of the concrete mixture thereat. The valve unit 5 includes a bottom discharge pipe 6 selectively opened and closed by a cover unit 7. An over-center linkage 8 is interconnected between the cover unit 6 and an operating handle 9 to permit selective opening and closing of the discharge pipe 6. Thus, in operation the concrete can be distributed by valve units 5 in flow line 1 to any one or more deposit sites 4. Whenever concrete is to be deposited as at site 4, the handle 9 is rotated from the illustrated closed position of FIG. 1 to the open position illustrated in FIG. 5.

The present invention is particularly directed to the provision of a unique and improved valve structure or unit 5 which is uniquely constructed for a concrete pumping systems. The construction of the concrete pump, the flow line, the other discharge means and the like can be of any known or suitable construction and consequently no further description thereof is necessary to clearly describe the illustrated embodiment of the invention.

Referring particularly to FIGS. 1–4, the illustrated embodiment of the valve units 5 includes a tubular metal conduit or pipe body 10 having an internal diameter essentially corresponding to the internal diameter of the other tubular sections 10*a* of the distribution system. The opposite ends of the pipe body 10 are formed with coupling ends 11 which are adapted to receive releasable couplings 12 for fixedly connecting of the pipe 10, and therefor the valve unit 5 in series within the flow line 1. The flow line may include flexible or rigid pipe sections 10*a*, generally of 10 foot lengths in practice. The sections 10*a* are connected on site to permit convenient location of the various portions of the flow line. This permits the convenient and proper location of the gate valve unit 5 with respect to the deposit sites 4.

Figure 3:
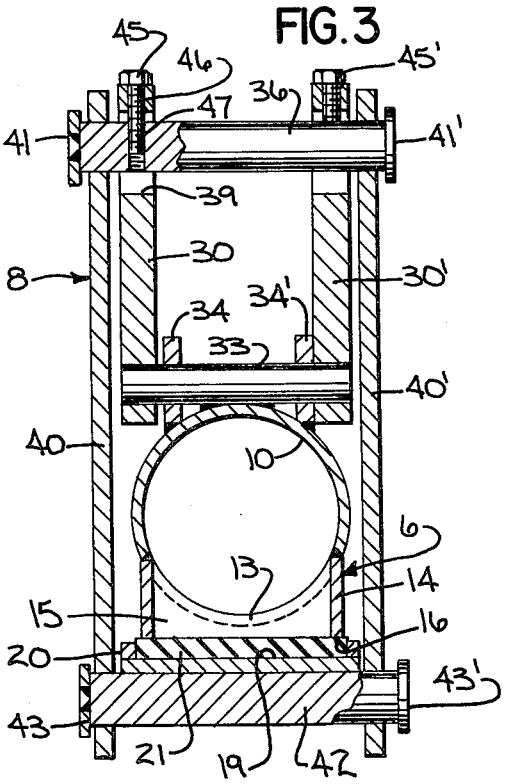
FIG. 3 is a vertical transverse section taken generally on line 3—3 of FIG. 1 and more clearly illustrating an over-center latch linking connection.
Figure 4:
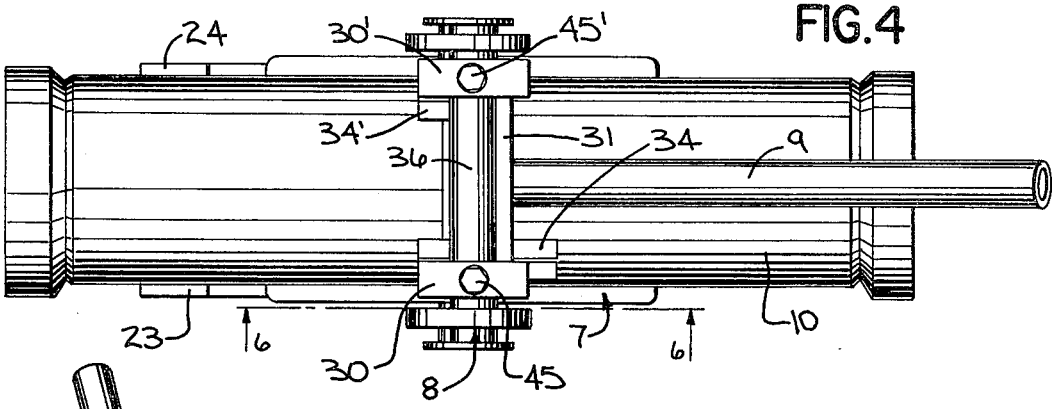
FIG. 4 is a plan view of the gate valve structure shown in FIG. 1.
Figure 6:
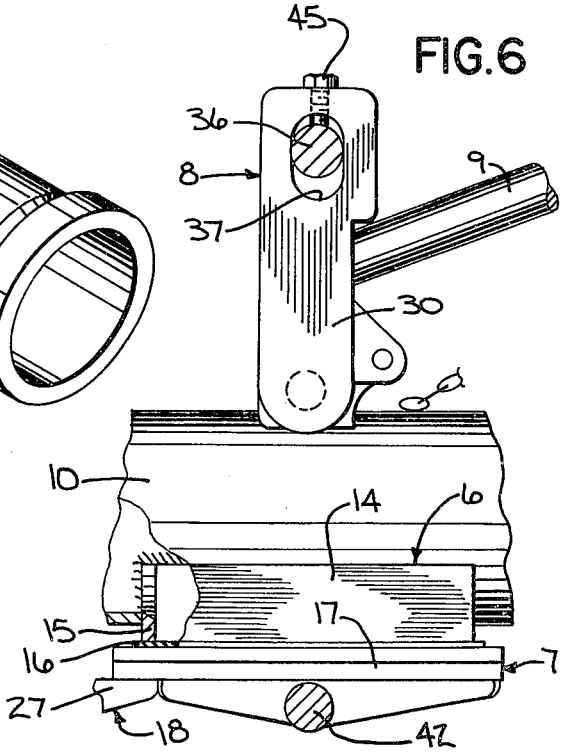
FIG. 6 is an enlarged side view illustrating a portion of the linkage connection to the valve body.

As shown most clearly in FIGS. 1 and 6, the discharge pipe 6 is located within a buttom discharge opening 13 cut or otherwise formed in the length of the pipe body 10. The discharge pipe 6 includes flat longitudinal side wall plates 14 secured to the longitudinal side edges of the opening 13 as by welding or the like. The adjoining edges of the pipe opening 13 and the pipe plates 14 are preferably welded to form a smooth, continuous transfer between the pipe body 10 and the discharge pipe 6. End wall plates 15 are similarly secured to the axial end walls of the opening 13. As shown in FIGS. 3 and 6, end walls 15 have inner curved edges essentially corresponding to the inner curved ends of the opening 13 as defined by the round pipe body 10. Plates 15 are welded into position to provide a smooth transfer between the pipe body 10 and the discharge pipe 6. The pipe plates 14 and 15 project outwardly of the pipe 9 and terminate in a flat edge ends 16 defining planar sealing surface for the discharge pipe 6. Although the particular construction and location is not critical, the illustrated embodiment shows the pipe 6 of a length equal to approximately $\frac{1}{3}$ of the pipe body 1, and of a depth equal to substantially $\frac{1}{4}$ the diameter thereof. Further, the discharge pipe 6 extends outwardly of the pipe a small distance, shown approximately 1/10 the diameter of the valve body 10 at the lowest point on the valve body. The projection should be made as small as possible to minimize the dimension of the pocket or recess introduced into the flow line and projecting beyond the periphery of the pipe body 10. Although a reasonably thin and small pocket or recess has been found acceptable in many applications, a very substantial projection would not be desirable from the flow standpoint, as well as a convenient integrated, mounting of the cover unit 7.

The illustrated cover unit 7 includes a flat cover plate 17 which is interconnected to the valve pipe body 10 by a hinge structure 18. The cover plate 17 includes a flat sealing surface 19 with an outer rim or ridge 20 defining a gasket retainer. A resilient gasket 21 is disposed within the retainer abutting the flat sealing face of the plate 17. The gasket 21 is of a slightly greater depth than the rim 20 in the unstressed and relaxed position such that it projects outwardly beyond the edge of the retainer.

The plate 17 is slightly larger than the perimeter of the discharge pipe 6 and the retainer 20 is located outwardly of the walls of the discharge pipe 6 to locate the gasket 21 in alignment with the sealing edge end 16 of the discharge pipe 6.

Although a planar sealing surface is desired to permit the most effect sealing, the flatness is not critical and some slight curvature or even offset can of course be tolerated.

Figure 5:
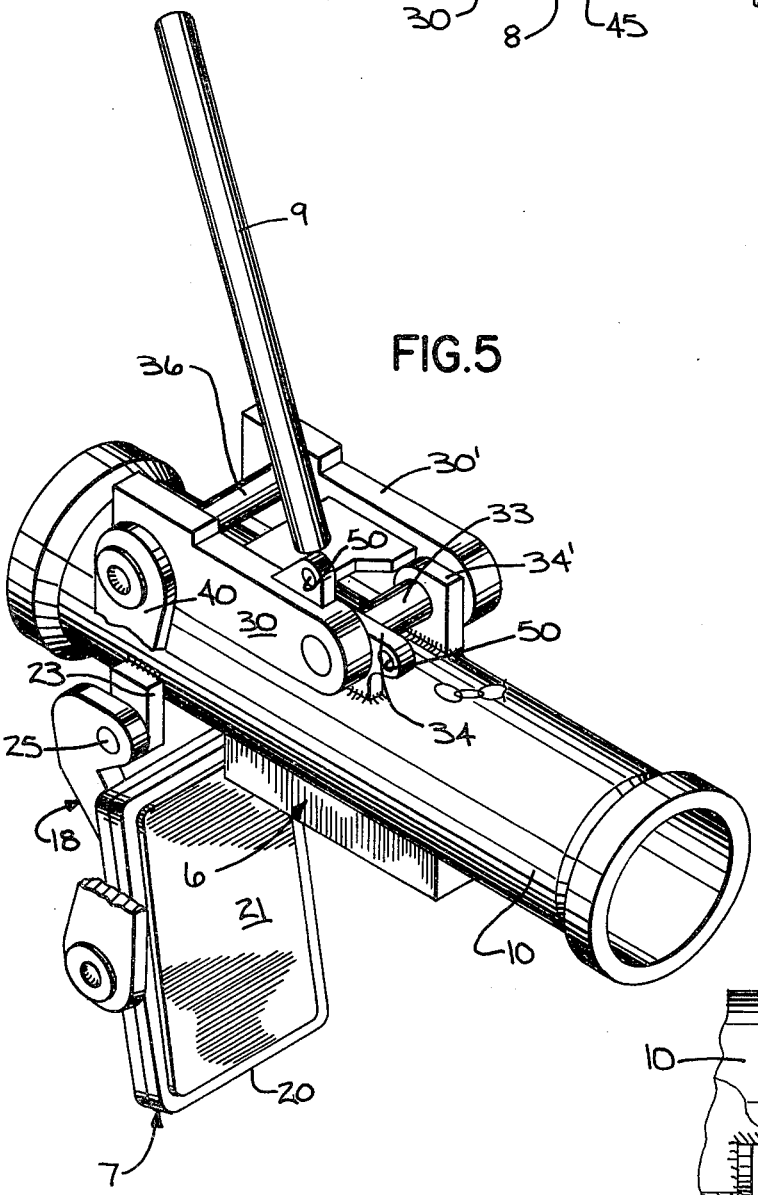
FIG. 5 is a perspective view of the gate valve structure shown in FIG. 1 with the gate valve in the opened position.

The cover plate 17 is located between the closed position shown in FIG. 1, and a pivoted open position shown in FIG. 5 by rotation of the handle 9 and pivoting of the cover unit 7 about its hinge unit 18 and a pivotal interconnection to the over-center linkage 8.

The illustrated hinge unit 18 includes a pair of similar cover hinge members 23 and 24 secured to the transverse opposite sides of the pipe body 10 in axially spaced relation to the discharge pipe 5. A pivot shaft 25 is secured within the hinge pivot members 23–24. The construction and arrangement is such that the shaft 25 abuts the peripheral under surface of the metal pipe body 10. The shaft 25 is preferably tacked, welded or otherwise rigidly affixed to the pivot hinge pivot members and to the engaged pipe body 10. Cover hinge members 27 are provided with pivot slot 28 located on the projecting ends of the shaft 25. The pivot members 27 are L-shaped members having a second branch or leg extended outwardly into overlapping relation to the back side of the cover plate 17. The extended overlapping legs of member 27 are welded or otherwise rigidly affixed to the plate 17 as at 29, and thus are integrated and extensions of such plate. The pivot slot 28 is an elongated slot which, in the closed position, extends downwardly below the pin or shaft 25. The slot 28 is also axially enlarged and in a direction away from the cover plate 17 as at **29*a* to permit the reverse axial movement of the cover plate 17** during the opening.

The handle assembly 9 is interconnected to and forms a part of the over-center linkage 8. The handle assembly 9 includes an H-shaped member having corresponding linkage to the opposite sides of the valve apparatus to form a balanced movement and interconnection to the cover unit 7, as most clearly illustrated in FIGS. 2–4, inclusive. A particular description is given of the detail of the linkage shown to the left side of FIG. 2, with the corresponding elements of the linkage members shown to the opposite side identified by corresponding primed numbers for purposes of simplicity of explanation.

The H-shaped member connection, including side links 30 and 30', are interconnected to each other by a stop plate 31 which is welded or otherwise rigidly affixed therebetween. The handle 9 is a pipe-like member rigidly affixed to the plate 31 as by a weld 32 or the like and extends outwardly at a predetermined angle to such plate. A shaft 33 is secured to the pipe valve body 10 generally directly opposite the longitudinal or axial center of the discharge opening and pipe 6. Handle link pivot members 34 and 34' are welded to the opposite sides of the pipe body, as shown in FIG. 3 and project outwardly to support shaft 33 and abutting the valve body 10. The handle links 30 and 30' are journaled on the opposite extending portions of the shaft 33 to the outer sides of the pivot link members 34 and 34'. The links 30 and 30' project outwardly from the shaft 33 with the upper end thereof pivotally attached to a pivot adjustment shaft or pin 36. The side link 30–30' include an elongated slot or opening 37 through which the pin 36 passes. The pin 36 is located within an elongated opening or slot 37 to form an adjustable connection as developed hereinafter, for precisely locating the linkage 8 with respect to the pipe body 10 and cover 7. The linkage 8 includes connecting links 40 and 40', one end of which is located on the pin 36 and the opposite end of which is pivotally connected to the cover 7. The upper end of the connecting link 40 is held in place by a retaining washer 41 secured to the end of the shaft.

The cover unit 7 includes a pin 42 welded or otherwise securely affixed to the back side of the plate 17 between the strengthening brackets or braces, and with the pin 42 extending outwardly beyond the side edges of the plate 17. The corresponding ends of the connecting links 40 and 40' are connected to the opposite projecting ends of the pin 42 and are secured thereto by a similar retaining washer 43.

The cover is preferably constructed as a flat metal plate to define a flat sealing surface in alignment with the lower edge of the discharge pipe. In order to maintain, a flat plate sealing surface, a plurality of strengthing braces in the form of metal strips 44 are welded or otherwise secured on edge to the back side of the plate in accordance with conventional construction.

The pivot adjustment 39 and 39' provide for accurate location of the connecting link 40 and 40' so as to establish a tight seal of the plate and particularly gasket 21 against the edge of the discharge pipe 6 in the closed position of the cover.

The adjustable connection of linkage 8 is most clearly illustrated in FIGS. 3 and 6. Referring particularly to FIG. 3, the link 35 is formed with the elongated slot 39 having a width essentially corresponding to the width of the pin 36. A screw or bolt 45 extends through a corresponding opening 46 in the end of the handle assembly link 30 and 30'. The pin 36 is provided with a threaded opening 47. The bolt 45 is journaled in the link and threads into the opening 47 to adjust the location of the link with respect to the handle assembly and therefor the latch pivot pin 33.

As most clearly illustrated in FIG. 1, the three pivot points 44–46 of the pivot pins 33, 36 and 42 define an over-center alignment located to the opposite sides of the pivot axis or point 44 of the pin 33 in the open and the close positions. As illustrated in FIG. 1, in the closed position, the plane 47, as shown by line, lying through the axii 45 and 46 is located just to the right of the pivot axis 44. This provides an over-center closing location of the linkage 7. The over-center position is limited to prevent collapse of the linkage by a stop interengagement between the handle assembly and the valve structure. In the illustrated embodiment of the invention, the handle plate 31 is located in alignment with the pivot members 34 and 34'. As shown most clearly in FIG. 2, in the close position, the stop edges of the handle plate 31 engage the hinge members 34 and 34' and positively locate and limit the movement of the latch linkage 7.

A locking means is shown to lock the unit in a closed position. In the illustrated embodiment of the invention, the left handle link 30 is provided with a locking lug 49 which projects outwardly adjacent to the pivot link 34. The lug and the extension are provided with aligned openings 50 in the close position to receive a latch pin 51 which may be secured to the pipe line by suitable chain unit.

In assembly, the discharge pipe 6 is welded or otherwise secured to the valve body. The cover unit 7, latch linkage 8 and handle 9 are assembled to the valve body 10 and to the cover 7. The bolt 45 is adjusted means 34 such that with the handle in the closed position. The cover 7 abutts pipe 6 with the desired sealing pressure, which may be selected to provide an essentially fluid tight connection under normal pump and surge conditions.

In operation, the handle is rotated clockwise as viewed in FIG. 1 and 5 to establish the closed position in which the locking pin unit 51 may be inserted into the locking opening 50. To open the valve, the pin is removed and handle 9 rotated counterclockwise to the position of FIG. 5. The cover 7 drops below and to the one side of the discharge pipe 6, and permits unrestricted flow from the pipe line.

The present invention provides an improved, reliable high pressure seal for semifluid material pumping system, such as for concrete and cement.

Various modes in carrying out the invention are contemplated as being within the scope of the following claims, particularly pointing out and distinctly claiming the subject matter which is regarded as the invention.

I claim:

1. A valve apparatus adapted to be connected in a concrete pumping system comprising a tubular valve body having opposite ends adapted to be releasably secured in fluid tight connection within a high pressure pumping line, said valve body having a discharge opening in one side thereof, said discharge opening have a rectangular shape including a longitudinal length greater than the circumferential length, a valve pipe secured to said opening and having a corresponding rectangular cross section corresponding to said opening and forming an extension of said opening, said valve pipe having an outer substantially planar sealing end surface, a valve closure plate means having a substantially flat sealing surface adapted to abut said planar sealing end surface to seal said pipe, a linkage means connected to said valve closure means and said valve body and including an operating member pivotally mounted for moving said valve closure means between a first closed position abutting said planar sealing end surface and a second open position spaced from the plane of the sealing end surface to fully open said discharge opening.

2. The valve apparatus of claim 1 wherein said planar sealing end surface being parallel to a plane through the axis of the tubular valve body.

3. The valve apparatus of claim 1 wherein said linkage means includes corresponding linkages to opposite sides of the valve body connecting the closure means to said operating handle and each of said linkages includes a handle hinge pivot means secured to said valve body, a handle link secured to said handle and pivoted to said pivot means and extended outwardly of the valve body to the opposite side of the valve body from said pipe, a connecting link pivotally secured to said handle link and to said closure plate means and located with respect to said hinge pivot means to define an over-center latch of the linkage means with the closure plate means in said first position.

4. The valve apparatus of claim 3 including locking means having releasably connected members secured one each to said handle link and to said valve body for releasably locking the linkage in place with the closure plate means in said first position.

5. The valve apparatus of claims 1 or 3 wherein said valve closure plate means includes a flat plate having said sealing face, said linkage includes a hinge means secured to said flat plate and to said valve body to pivotal support said flat plate, said hinge means being constructed and arranged to establish relative translation of said plate relative to said pivot axis.

6. In a high pressure concrete pumping system having a pumping line for transport of concrete and pump means operating at pressure of at least 500 PSI, a bottom discharge valve apparatus connected in said line for discharge of concrete from an intermediate portion of said line comprising a tubular valve body forming said intermediate portion of said line and including a discharge opening located to one side of the valve body, a rectangular discharge pipe secured within said opening and projecting outwardly to a flat end sealing surface, said discharge pipe extending outwardly substantially less than the radius of the valve body, a cover plate having a flat sealing surface adapted to cover said flat end sealing surface of said discharge pipe, a cover hinge having a body member secured to said valve body and a cover member secured to one axial end of said cover plate and including a pin and slot connection for pivotally supporting said cover plate with translation of the cover plate hinge member during pivoting of the cover plate between a closed pipe position engaging the end of the rectangular discharge pipe and an open pipe position with the cover plate spaced from the plane of the discharge pipe, a pair of link pivot members secured to the valve body to the opposite side from said discharge pipe and including a pivot axis aligned with the pivot axis of the pivot connection of the connecting links to said cover plate, a handle assembly including a pair of handle links having a connecting member interconnected intermediate the length of said links, a handle secured to said connecting member, said handle link being pivotally mounted one each on said link pivots and extending outwardly therefrom to outer ends, a pair of connecting links pivotally secured to said cover plate, one each to the opposite sides of said valve body and extending past said valve body to outer ends, and pivot means connecting said outer ends of said connecting links to said outer ends of said handle links and forming an over-center latch of the cover plate in abutting sealing engagement with said discharge pipe.

7. In the pumping system of claim 6 wherein said discharge opening and pipe have an axial length greater than the diameter of said valve body and width less than the diameter of said valve body.

8. In the pumping system of claim 6 wherein said one pivot member and the adjacent handle link include locking means to releasably lock the cover plate in the closed pipe position.

9. In the pumping system of claim 6 wherein said cover plate includes an encircling gasket retainer, a sealing gasket secured to the sealing face within said retainer, said gasket extending outwardly of said retainer.

10. The system of claim 6 wherein said cover hinge means includes a pin located in a slot, said slot having a length greater than the diameter of the pin and having one end with a width corresponding to the diameter of the pin and an expanding width to the opposite end to establish said translation of the cover during said pivotal movement of said cover.

11. The valve apparatus of claim 6 wherein said tubular body has an internal diameter of five to eight inches and said discharge pipe projects approximately one quarter inch from the tubular body.

12. The valve apparatus of claim 6 wherein said discharge opening extends into substantially one-third of said valve body and said discharge pipe projects substantially less than said distance from said valve body.

* * * * *

UNITED STATES PATENT AND TRADEMARK OFFICE

CERTIFICATE OF CORRECTION

PATENT NO. : 4,437,646

DATED : March 20, 1984

INVENTOR(S) : DAVID E. BIGELOW ET AL

It is certified that error appears in the above-identified patent and that said Letters Patent is hereby corrected as shown below:

Col 1, line 49, Cancel "the" and substitute therefor ---The---; Col. 2, Line 26, Cancel "opon" and substitute therefor ---open--- Col. 3, line 27, Cancel "linking" and substitute therefor ---linkage---; Col. 7, line 33, Claim 1, After "Closure" insert ---plate---; Col. 7, line 36, Claim 1, After "closure" insert ---plate---; Col. 7, line 46, Claim 3, After "closure" insert ---plate---; Col. 7, line 64, Claim 5, Delete "face" and substitute therefor ---surface---; Col. 8, line 21, Claim 6, After "slot" insert ---pivot---.

Signed and Sealed this

*Eighteenth* Day of *December 1984*

[SEAL]

*Attest:*

*Attesting Officer*

GERALD J. MOSSINGHOFF

*Commissioner of Patents and Trademarks*